US009306265B1

(12) United States Patent
Hossein-Zadeh

(10) Patent No.: US 9,306,265 B1
(45) Date of Patent: Apr. 5, 2016

(54) LOW POWER PHOTONIC CONTROL OF MICROWAVE POWER USING BULK ILLUMINATION AND RF RESONANCE

(71) Applicant: STC.UNM, Albuquerque, NM (US)

(72) Inventor: Mani Hossein-Zadeh, Albuquerque, NM (US)

(73) Assignee: STC.UNM, Albuquerque, NM (US)

( * ) Notice: Subject to any disclaimer, the term of this patent is extended or adjusted under 35 U.S.C. 154(b) by 140 days.

(21) Appl. No.: 14/083,140

(22) Filed: Nov. 18, 2013

Related U.S. Application Data

(60) Provisional application No. 61/728,122, filed on Nov. 19, 2012.

(51) Int. Cl.
*H01P 7/08* (2006.01)
*H01P 7/00* (2006.01)

(52) U.S. Cl.
CPC . *H01P 7/00* (2013.01); *H01P 7/088* (2013.01)

(58) Field of Classification Search
CPC ... H01P 1/20381; H01P 1/20354; H01P 7/08; H01P 7/082; H01P 7/088
USPC ..... 333/204, 205, 219, 235
See application file for complete search history.

(56) References Cited

U.S. PATENT DOCUMENTS

| | | | | |
|---|---|---|---|---|
| 4,282,499 | A * | 8/1981 | DeFonzo | 333/231 |
| 6,825,742 | B1 * | 11/2004 | Luque | 333/204 |
| 2010/0301971 | A1 * | 12/2010 | Yonak et al. | 333/219.1 |

* cited by examiner

*Primary Examiner* — Robert Pascal
*Assistant Examiner* — Gerald Stevens
(74) *Attorney, Agent, or Firm* — Keith A. Vogt; Vogt IP

(57) ABSTRACT

A photonically controlled microwave device having a photosensitive substrate having an interior region comprising a high radio frequency ("RF") field for a resonant RF mode. An RF resonator is patterned on a surface of the substrate, the pattern includes an aperture in the resonator positioned to direct light received from a light source to the interior region. The light source may have a wavelength that enables illumination of the interior region to generate free carriers or other photo-induced changes in RF permittivity. An optical boundary may be provided that recirculates the unabsorbed optical power inside the high RF field region until it is fully absorbed.

14 Claims, 20 Drawing Sheets

| Wavelength (nm) | dB/(W/mm$^2$) | dB/mW | Geometry | Frequency (GHz) | Material |
|---|---|---|---|---|---|
| 1064 | 173 | 5.5 | Ring | 13.7 | Silicon |
| 513 | 1.9 | X | Stub | 6 | Silicon |
| 513 | 19 | X | Stub | 4 | Silicon |
| X | X | 4.1 | OVC | 14 | III-V |
| 870 | X | 1 | interdigital | 6 | Silicon |
| 820 | X | 0.8 | CPW-gap | 6 | Silicon |
| Xe arc lamp | 85.7 | X | Waveguide | 50 | Silicon |
| 850 | X | 0.35 | Stub | 7 | Silicon |
| 808 | X | 0.09 | Si-gap | 8.4 | Silicon |
| < 1000 | X | 1.15 | Stub | 6.9 | Silicon |
| 808 | X | 0.08 | CPW-gap | 6.9 | Silicon |

Figure 12

LOW POWER PHOTONIC CONTROL OF MICROWAVE POWER USING BULK ILLUMINATION AND RF RESONANCE

CROSS-REFERENCE TO RELATED APPLICATIONS

This application claims the benefit U.S. Provisional Application No. 61/728,122, filed Nov. 19, 2012 and herein incorporated by reference.

STATEMENT REGARDING FEDERALLY SPONSORED RESEARCH OR DEVELOPMENT

This work was supported by AFOSR grant FA9550-09-1-0202.

INCORPORATION-BY-REFERENCE OF MATERIAL SUBMITTED ON A COMPACT DISC

Not Applicable.

BACKGROUND OF THE INVENTION

Field of the Invention

Photonic control of radio frequency (hereinafter "RF") signal propagation in a microwave device has many advantages over conventional electrical control. Photonic control provides a high degree of electrical isolation between the control signal and the microwave circuit, it provides immunity to parasitic electromagnetic radiation, it is capable of high power handling, it enables remote control and it achieves overall weight reduction. In addition, photonic control provides a degree of high-speed control and timing precision that is superior to electrical control arrangement.

In particular electrical isolation between the control signal and the microwave structure is an important design consideration in the fabrication of reconfigurable antennas since the radiation pattern and efficiency are affected by the presence of control devices and circuits in the vicinity of the antenna pattern. As a result, to electrically isolate the components, a number of techniques, devices and materials have been explored for designing photonically controlled switches, phase shifters and attenuators. In these approaches, photonic carrier generation is on the surface of a semiconductor that controls the amplitude and the phase of the RF signal propagating on a microstrip or coplanar transmission lines.

Free carrier generation in biased and unbiased junctions as well as junction-less regions have been used to control the RF field in discontinuities, stubs, resonators and terminations. Except in a few cases where the photosensitive element is added to a transmission line fabricated on a low loss RF substrate, in most proposed structures, the RF circuit is fabricated on the photosensitive semiconductor substrate in order to reduce the complexity of the fabrication process and to keep the device monolithic. Although compound semiconductors have been also used as the structural materials in these devices, implementation of photonically controlled RF devices on silicon substrates is more attractive for monolithic integration of microwave and mm-wave devices using well-developed fabrication processes.

Independent of the material and the device structure, a laser wavelength between 600 nm and 900 nm is commonly used to maximize optical absorption and carrier generation. As a result, the optically affected region has been confined at the substrate surface due to small optical penetration depth at these wavelengths. Consequently, the performance and sensitivity of these devices, as measured in terms of RF transmission change per 1 mW of optical power, is typically less than 2 dB per mW of optical power.

The confinement of free carriers on the surface of substrate limits the interaction of the resonant field and the free carriers. In these cases, the presence of free carriers has been mainly modifying the electrical properties at the boundaries of the resonator, effectively tailoring the conductor size.

Since photonic free carrier generation controls the RF propagation in optically controlled components, strong optical absorption is one of the criteria for choosing the photoconductive material and the corresponding wavelength. On the other hand, to reduce the fabrication cost and complexity, usually one material system is used in the device fabrication. As a result, low-loss optical waveguides cannot be easily integrated with the device to deliver light directly to the sensitive region and almost all devices are controlled by top illumination to avoid absorption before reaching the sensitive region.

Silicon is one of the most common substrates used in phonically controlled RF devices (mainly because of compatibility with IC fabrication and low fabrication cost). FIG. 1 shows the absorption depth (δ, the depth at which the light intensity drops to 36% of its value at the interface) plotted against wavelength for silicon substrate. Below 900 nm d is less than 30 microns and all the photo-generated carriers are effectively confined at the surface (interface between air and silicon). That is one of the reasons why optical control has only been achieved by tailoring the conductive structure on top of the semiconductor substrate using a laser beam.

BRIEF SUMMARY OF THE INVENTION

The present invention provides a solution to the above problems by selecting an optical wavelength having an absorption depth that is large enough to enable bulk illumination (bulk photogeneration) specifically in the region of the substrate or body where most of the RF field is confined resulting in an enhanced interaction between the RF field and the photogenerated carriers. In addition, by using an RF resonator/resonant structure (as opposed to traveling wave configurations) the RF field is confined in a small volume and passively amplified. Bulk illumination of an interior region of a resonant configuration having a high intensity RF field results in a large RF-optical (and therefore RF-free carrier) overlap integral.

The present invention provides a significant increase in performance. It achieves 5.5 dB with less than 1 mW of optical power. This superior performance and sensitivity is achieved by the novel application of bulk laser illumination of a substrate through the use of a wavelength that penetrates beyond the surface of the substrate, a highly confined resonant RF field and an optional optical boundary condition that recirculates the unabsorbed optical power inside the high RF field region until it is fully absorbed.

For silicon, bulk illumination in the 1000-1100 nm range is used to control the resonant field inside a microwave resonator such as an RF ring. Results associated with the invention have shown that the transmitted RF power through a microstripline-ring filter on a junction-less silicon substrate can be changed by 11 dB with less than 2 mW of interacting optical power.

BRIEF DESCRIPTION OF THE SEVERAL VIEWS OF THE DRAWINGS

FIG. 12 is a table summarizing results of previous photonically controlled RF circuits and an embodiment of the present invention, independent of the material and the specific design, with all devices using optical illumination to control the RF field through photo-carrier generation.

DETAILED DESCRIPTION OF THE INVENTION

The following description of the preferred embodiments focuses on fabricating a photonically controlled microwave device that generally has a photosensitive substrate having an interior region comprising a high RF field for a designated RF mode. A resonator is patterned on a surface from a conductive material, with the pattern having an aperture positioned to direct light received from a light source to the interior region. The light source may have a wavelength that enables illumination of the interior region to generate free carriers or other photo-induced changes in RF permittivity. An optical boundary may also be provided for recirculating light inside the high RF field region for maximum absorption. For a planar substrate, a ground plane with high optical reflectivity can play this role.

Figure 1:
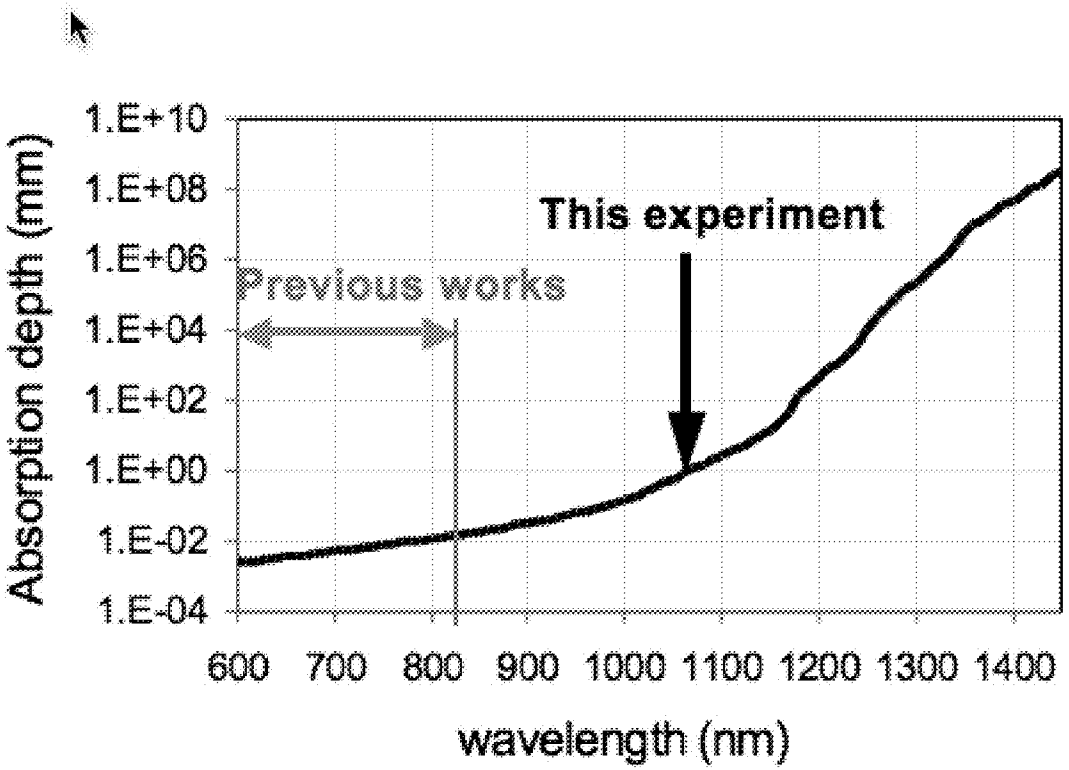
FIG. 1 is a graph of absorption depth of silicon plotted against wavelength.
Figure 2:
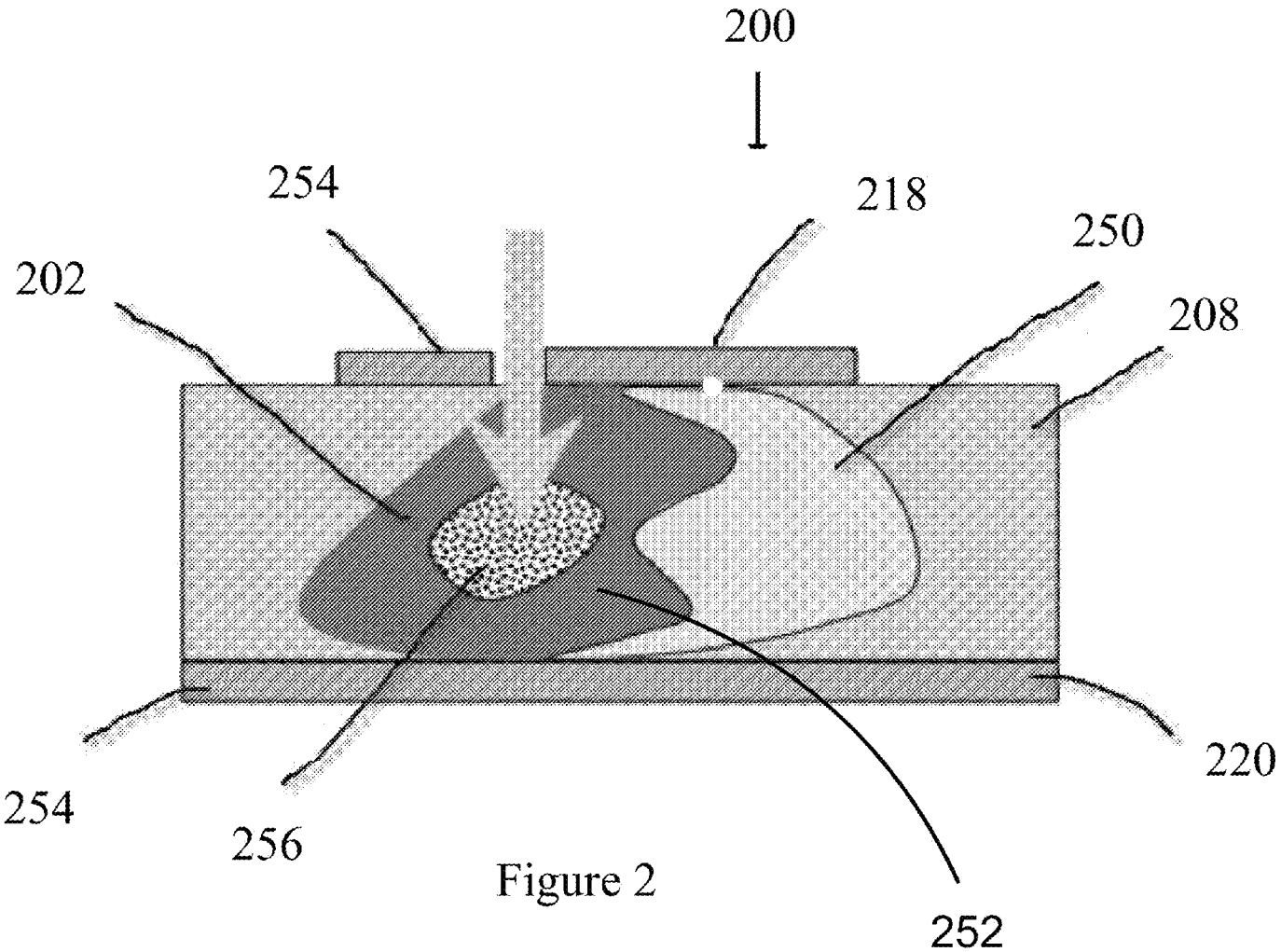
FIG. 2 illustrates an exemplary arrangement of an embodiment of the present invention in a planar configuration.
Figure 3:
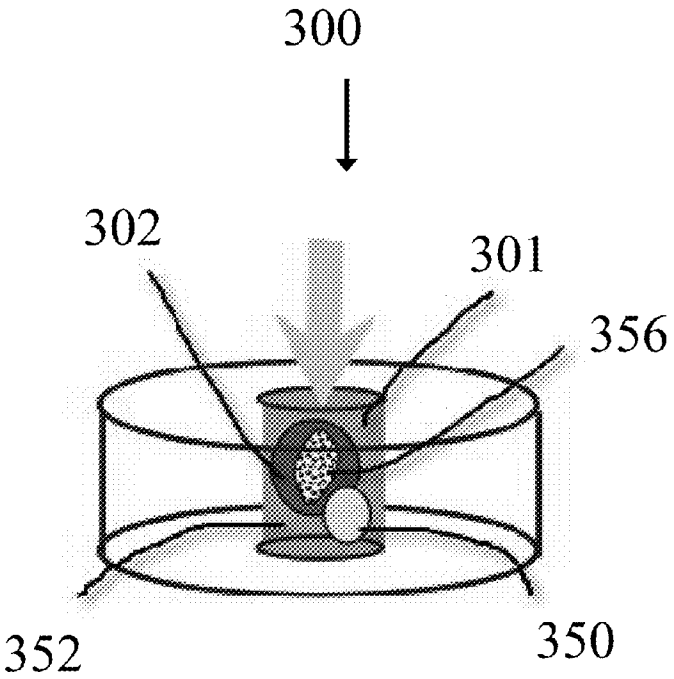
FIG. 3 illustrates an exemplary arrangement of an embodiment of the present invention using a three dimensional configuration.
Figure 4:
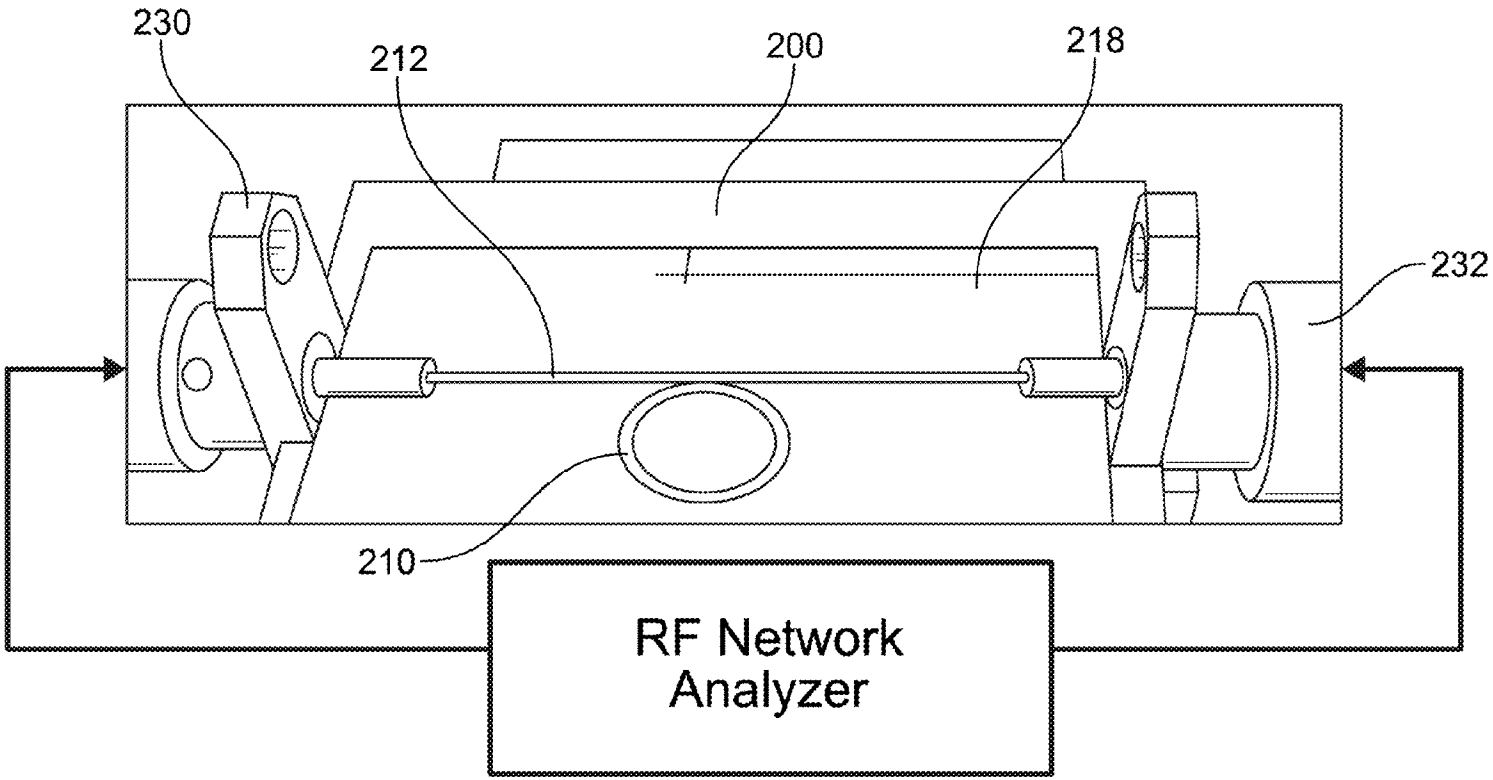
FIG. 4 illustrates a microring coupled to a microstripline on a silicon substrate.

FIGS. 2 and 4 depict a preferred embodiment consisting of a RF ring resonator 200. However, as shown in FIG. 3, an RF resonator 300 can have a three dimensional body 301, such as a cylindrical dielectric or metallic resonator. The body of the resonator may take any desired shape and has an interior region having a high RF field region for a designated RF mode filled by a photosensitive material 202, as shown in FIG. 2, or a high RF field region 302 as shown in FIG. 3 (i.e. permitivity or conductance are sensitive to optical illumination).

Other regions and structures of the device, as shown in FIG. 2, also include a low field region 250, a photosensitive region 252, conductor 254 and a region 256 in which photo free carriers or other photo-induced changes in permitivity are generated. Similarly, FIG. 3 depicts a low field region 350, a photosensitive region 352, and a region 356 in which photo free carriers or other photo-induced changes in permittivity are generated.

FIGS. 2 and 4 show an embodiment of the invention configured as an RF ring resonator 200 on a silicon substrate 208. A preferred wavelength that may be used is 1064 nm with an absorption depth of about 1 mm in silicon that is two times the thickness of the substrate which may be 500 μm. However, a wavelength of 1000-1100 nm range may also be used to control the resonant field inside resonator 200.

As shown in FIG. 4, ring 210 is side-coupled to microstripline or transmission line 212. Alternately, ring 210 may be side-coupled by being tangentially located next to transmission line 212 as well.

The ring resonator and the transmission line are fabricated on a 500 μm silicon substrate with a resistivity of about 2000 Ω-cm. Two layers (~2 μm) of copper 218 and 220 are coated on both sides of the silicon 208 using RF sputtering (a 50 nm layer of chromium may be used between the copper and silicon to improve the attachment). Ring 210 and microstripline 212 are created by patterning the top copper layer using photolithography and wet etching.

A wavelength that has an absorption depth of about two times the thickness of the substrate ensures bulk illumination and uniform distribution of photo-carriers across the substrate or body. This allows for the light to travel through the substrate and reach an optical boundry which may be a metallic layer 220 or other means known to those of skill in the art. The optical boundry recirculates light by directing or reflecting it back into substrate 208 to increase the efficiency of the device by causing further photo generated free carriers or other photo-induced changes in permittivity.

Ring 210 resonator may have a diameter of 5.3 mm and a width of 0.43 mm. Microstripline 212 may have a 50-ohm line (width ~0.43 mm) and two SMA launchers 230 and 232 were used to couple RF power into and out of the microstripline.

Figure 5A:
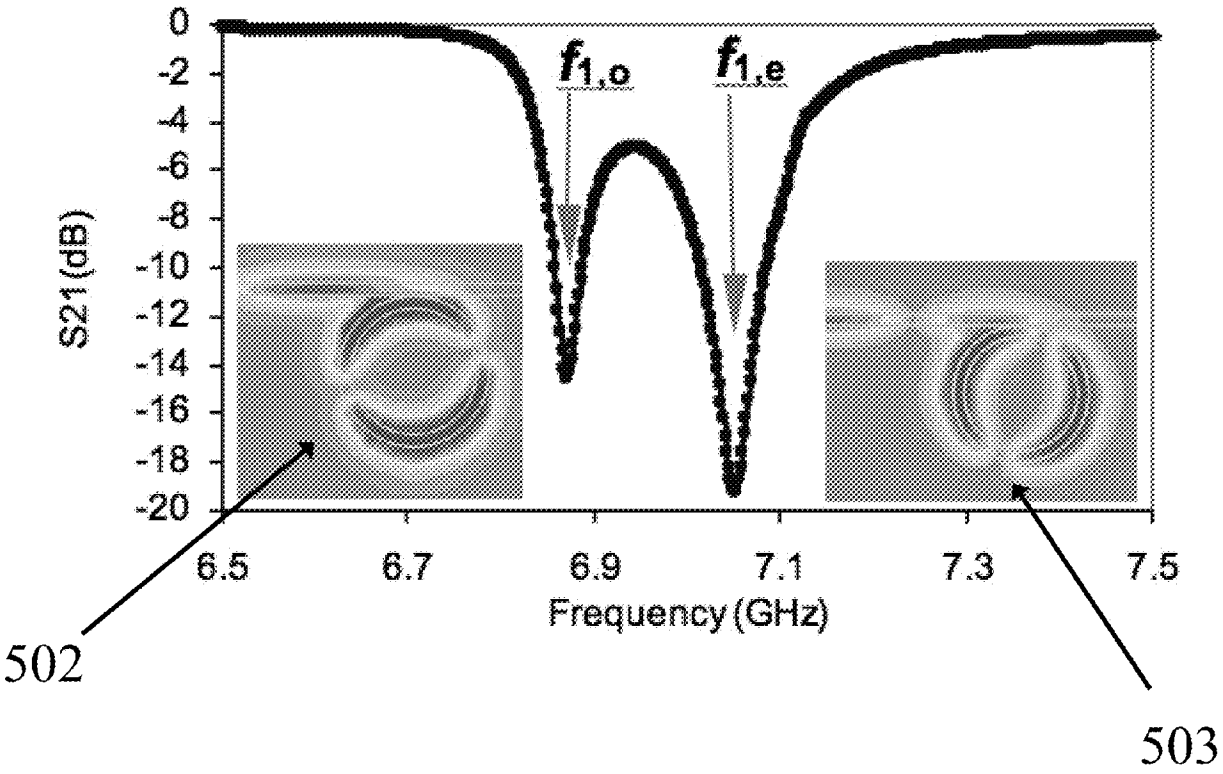
FIG. 5A is a graph of the simulated transmission spectrum of the microstripline coupled to the ring resonator near the fundamental resonance.
Figure 5B:
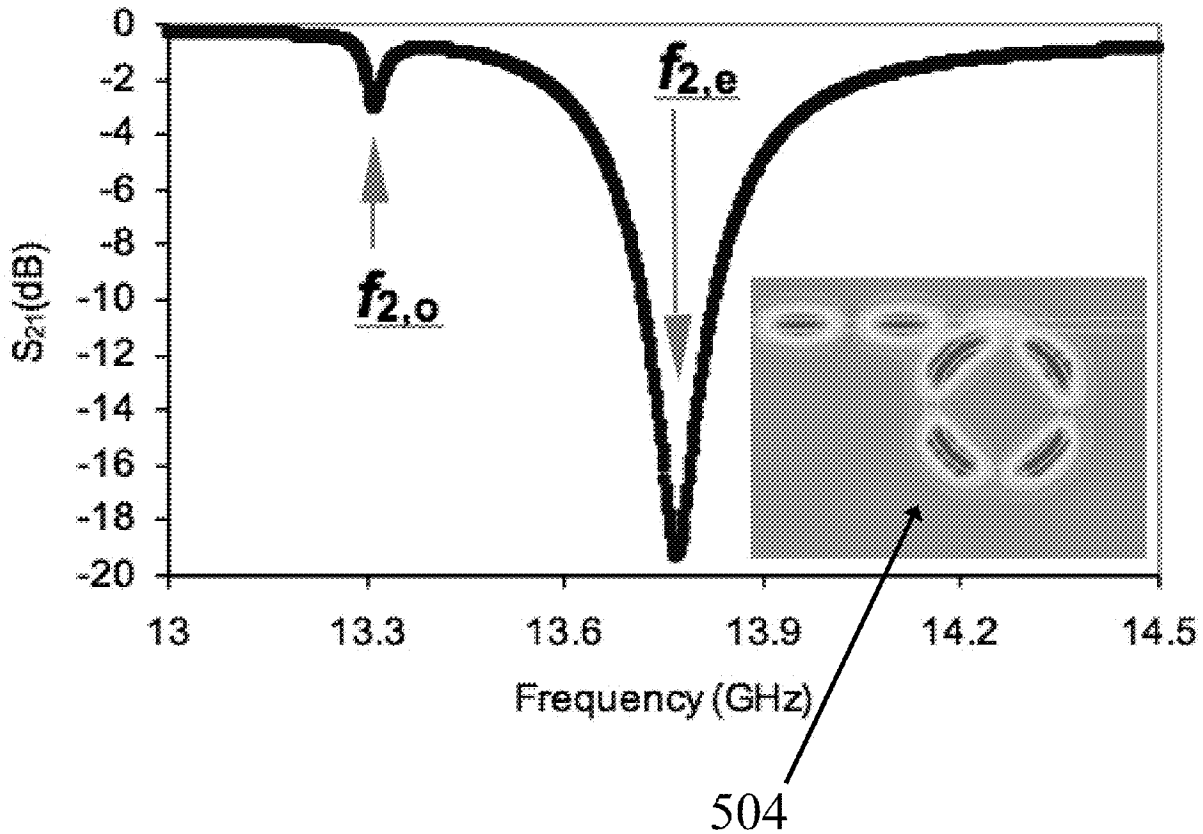
FIG. 5B is a graph of the simulated transmission spectrum of the microstripline coupled to the ring resonator near the second harmonic resonance.

When a ring resonator 210 is side-coupled to microstripline 212 the degeneracy between frequencies of the even and odd resonant modes will be removed due to the asymmetric coupling. As a result, two dips appear near each resonance in the transmission spectrum of the microstripline 212. Finite element microwave modeling software (CST) was used to calculate the frequencies and the field distribution for the first two modes of the microring resonator 210. FIGS. 5A and 5B show the simulated transmission spectrum (S21) as well as the electric field distribution for the fundamental and the second-harmonic mode of the ring resonator. Below 15 GHz four modes are excited: the odd fundamental mode (f1,o), even fundamental mode (f1,e), odd second-harmonic mode (f2,o) and even second-harmonic mode (f2,e) as shown in FIGS. 5A and 5B. Insets 502-504 show the electric field magnitude on a plane located in the middle of the silicon substrate (250 micron depth).

Figure 6:
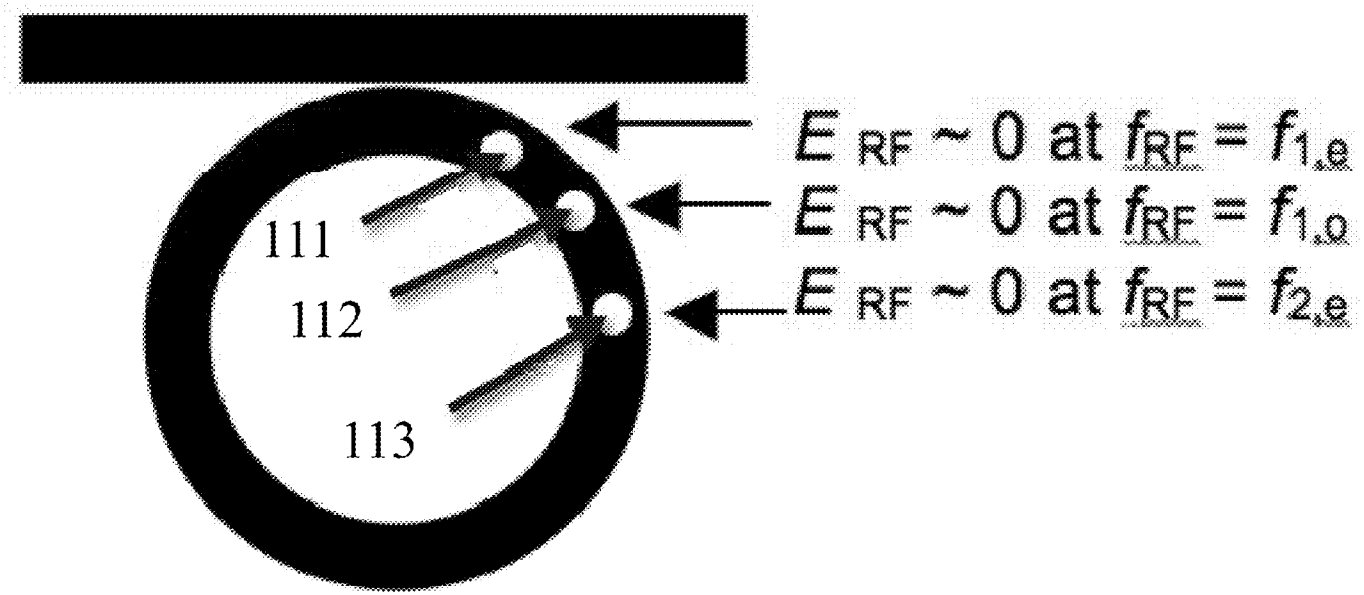
FIG. 6 illustrates the location of three apertures on the three different ring resonators.
Figure 7:
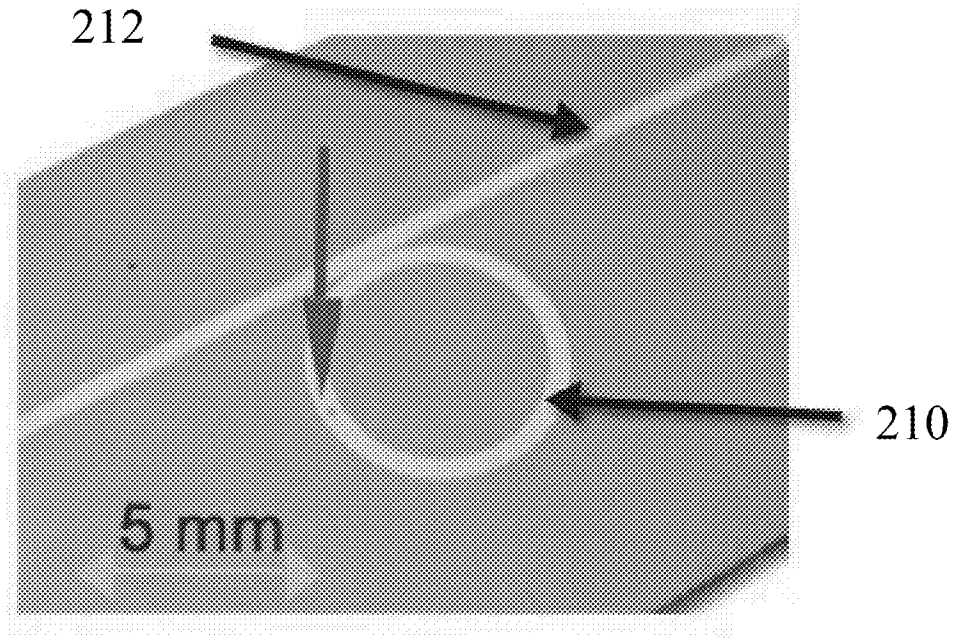
FIG. 7 is an expanded view of a microring with an aperture.

As shown in FIG. 6, three different locations 111-113 near the minimum field-strength region for each one the RF modes for optical illumination were selected. At each location a circular aperture on the copper ring was used to expose the substrate to laser light. The diameter of the aperture may be 0.2 mm (about 50% of the ring width) to minimize its effect on the RF resonance. This created three samples with identical rings and coupling gaps but with different aperture positions. FIG. 7 is an expanded view of a microring with an aperture at 113.

Figure 8:
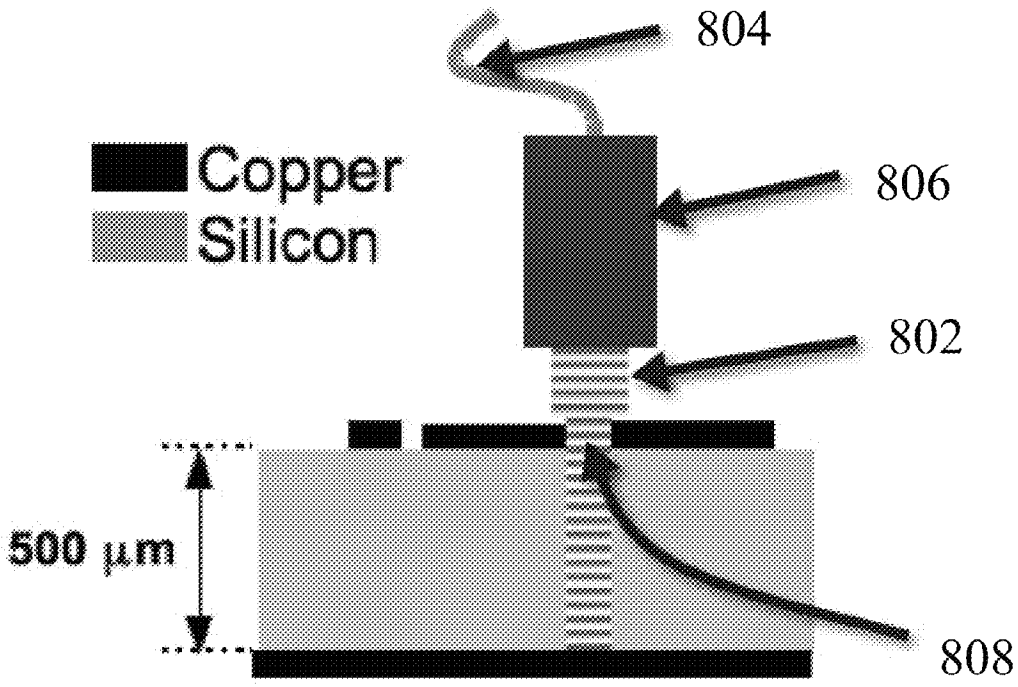
FIG. 8 is a schematic diagram of a collimator vertically coupling laser light to the silicon substrate.
Figure 9:
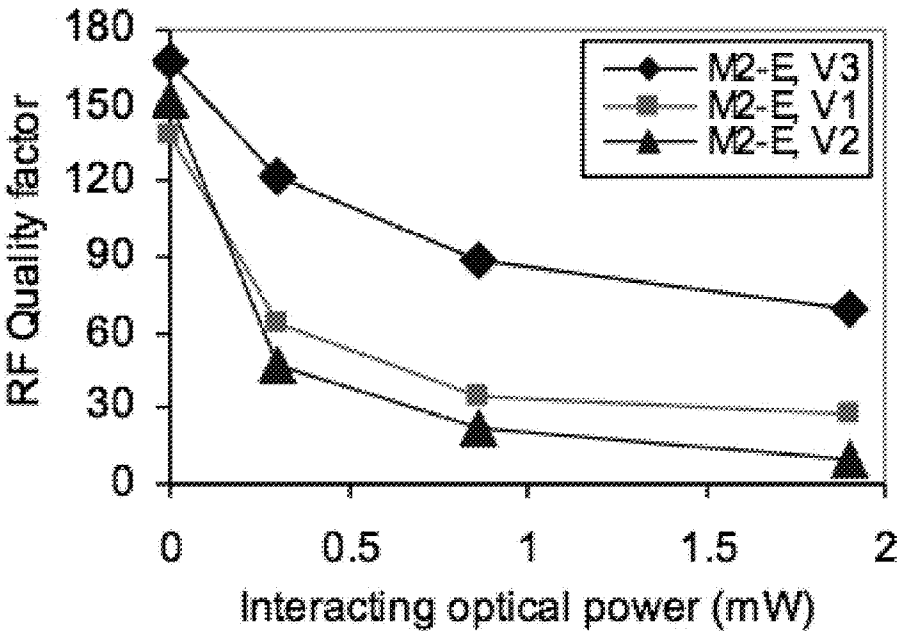
FIG. 9 is a graph of the measured values of RF quality factor against interacting optical power entering the substrate.
Figure 10:
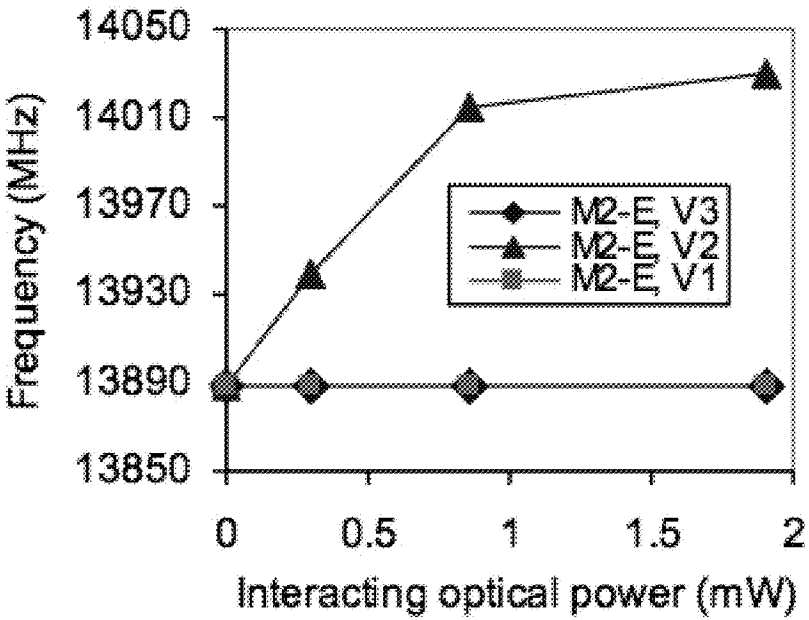
FIG. 10 is a graph of the measured values of resonant frequency against interacting optical power entering the substrate.
Figure 11:
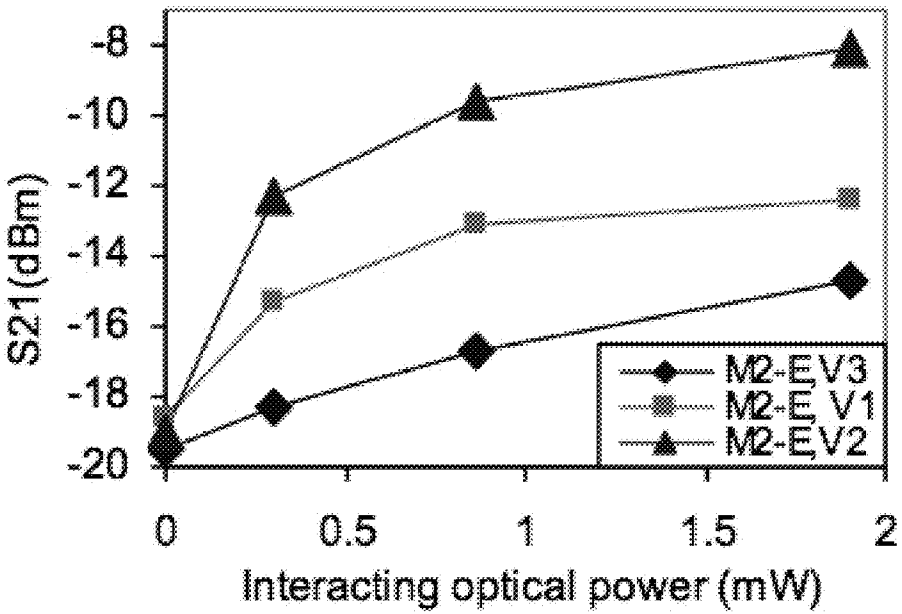
FIG. 11 is a graph of the measured values of the S21 at resonance against interacting optical power entering the substrate.

As shown in FIG. 8, a 1064 nm laser light 802 from a fiber pigtailed laser diode 804 may be fed to a fiber pigtailed collimator 806 which is vertically coupled to the substrate through aperture 808. Transmission near the second-harmonic resonance can be controlled and therefore function as a single frequency optical RF switch. FIGS. 9-11 show the RF quality factor (unloaded), frequency and the transmitted RF power ($S_{21}$) at $f_{RF}=f_{2,e}\sim13890$ MHz (resonant frequency of M2-e) plotted against the interacting optical power. Note that at a single wavelength (1064 nm), optical reflection from the silicon-air interface can be easily canceled by depositing two layers of dielectric on top of the silicon with almost no effect on the RF properties.

To estimate the ultimate performance of the device, the optical power inside the silicon was considered (or "the interacting optical power") instead of the incident optical power. The unloaded RF quality factor has been estimated using the $S_{21}$ spectrum based on the 3-dB linewidth measured from the bottom of each transmission dip.

The quality factor of the modes degrades due to loss generated by free carriers. The frequency does not change when aperture 112 and 113 are illuminated and it changes only by 1% when aperture 111 is illuminated.

As shown, for this embodiment, the frequency change is minimal because the photo-carriers do not increase the RF-length as opposed to previous resonant structures where the photo generated carriers at the surface change the RF-length and therefore the resonant frequency. Decoupling the frequency shift and attenuation is important because in narrow-band resonant systems attenuation at certain frequencies is desired.

FIG. 12 is a table summarizing RF transmission change per 1 mW of optical power for various photonically controlled RF circuits including an embodiment of the present invention. Independent of the material and the specific design, all devices use optical illumination to control the RF field through photo-carrier generation. In terms of maximum RF transmission change per 1 mW of optical power, the present invention outperformed the previous devices. Unlike the prior devices, which function based on optical surface effects, or the use of complex structures, junctions and compound semiconductor material, the present invention may be completely made on a uniform silicon substrate and does not use any bias voltage or a p-n junction. Nonetheless, the present invention has the largest optical sensitivity. The enhanced sensitivity is a result of the large overlap between the photo-carrier density and the oscillating RF field in the silicon substrate from bulk illumination of the interior of the substrate or body.

The present invention has applications in optical switching of microwave power and the design of optically reconfigurable RF circuits and antennas. It can also function at higher frequencies by reducing the ring resonator diameter or using higher harmonics of the same ring. Optical sensitivity in smaller rings may be due to the larger ratio between the optically attenuated RF field and the total resonant RF field. Moreover, by coupling more rings, several frequencies can be switched simultaneously resulting in a more flexible and versatile RF transmission spectrum.

Figure 13:
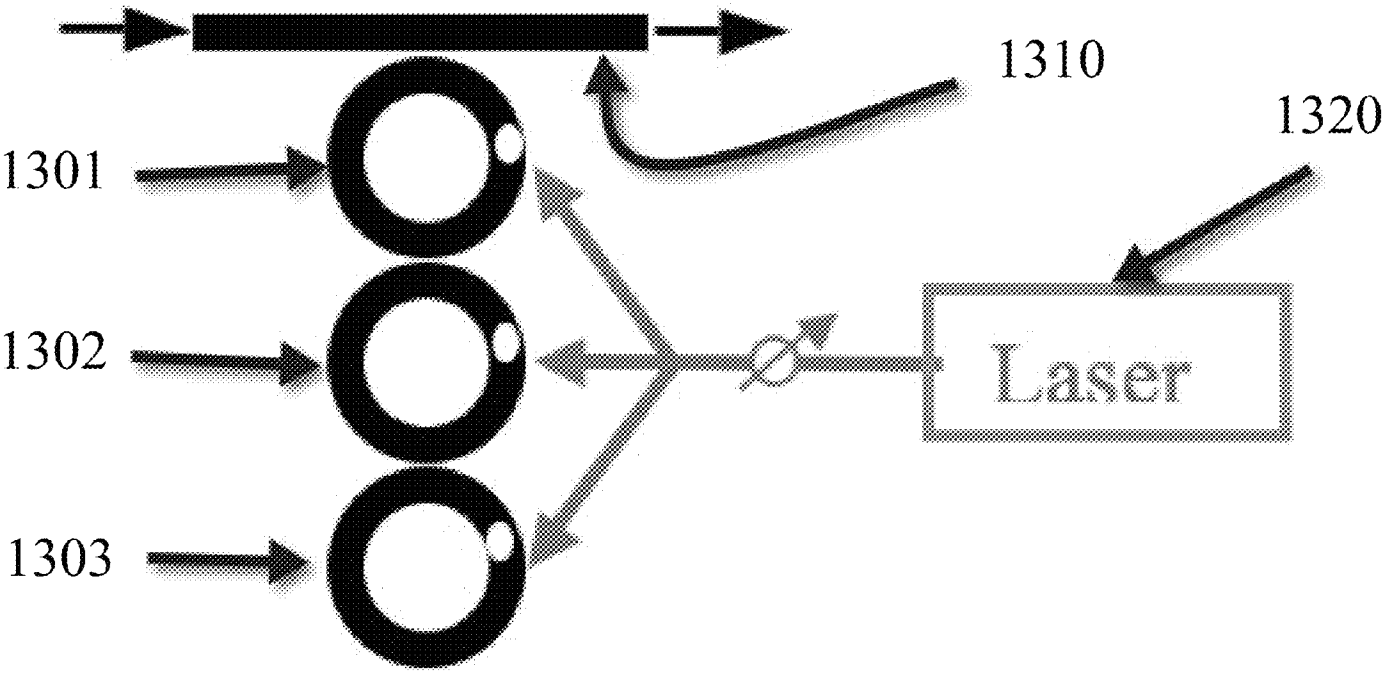
FIG. 13 is a schematic diagram of an optically controlled 3-pole RF filter, with optical power divided among the rings.
Figure 14:
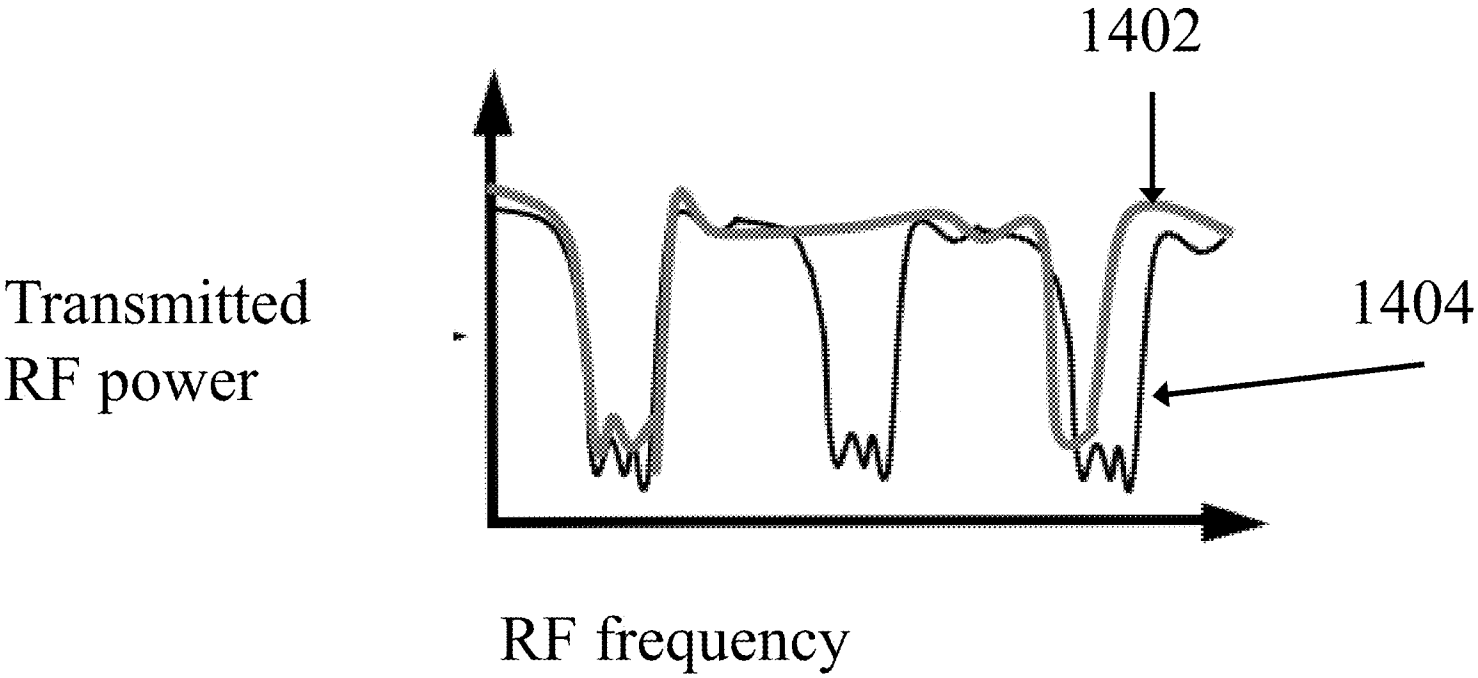
FIG. 14 shows how illuminating different location of the rings shown in FIG. 13 results in different stop-bands that can be controlled.

FIG. 13 illustrates an alternate embodiment of the invention. As depicted, three identical coupled ring resonators 1301-1303 are side-coupled to or located near microstrip 1310. The configuration comprises a three-pole RF band-stop. Optical power from laser 1320 is divided among the rings. By selectively illuminating a different location of the rings, the transmission at different stop-bands can be controlled. As shown in FIG. 14, line 1402 shows the transmission of the device with illumination and line 1404 shows the transmission of the device with no illumination.

Figure 15:
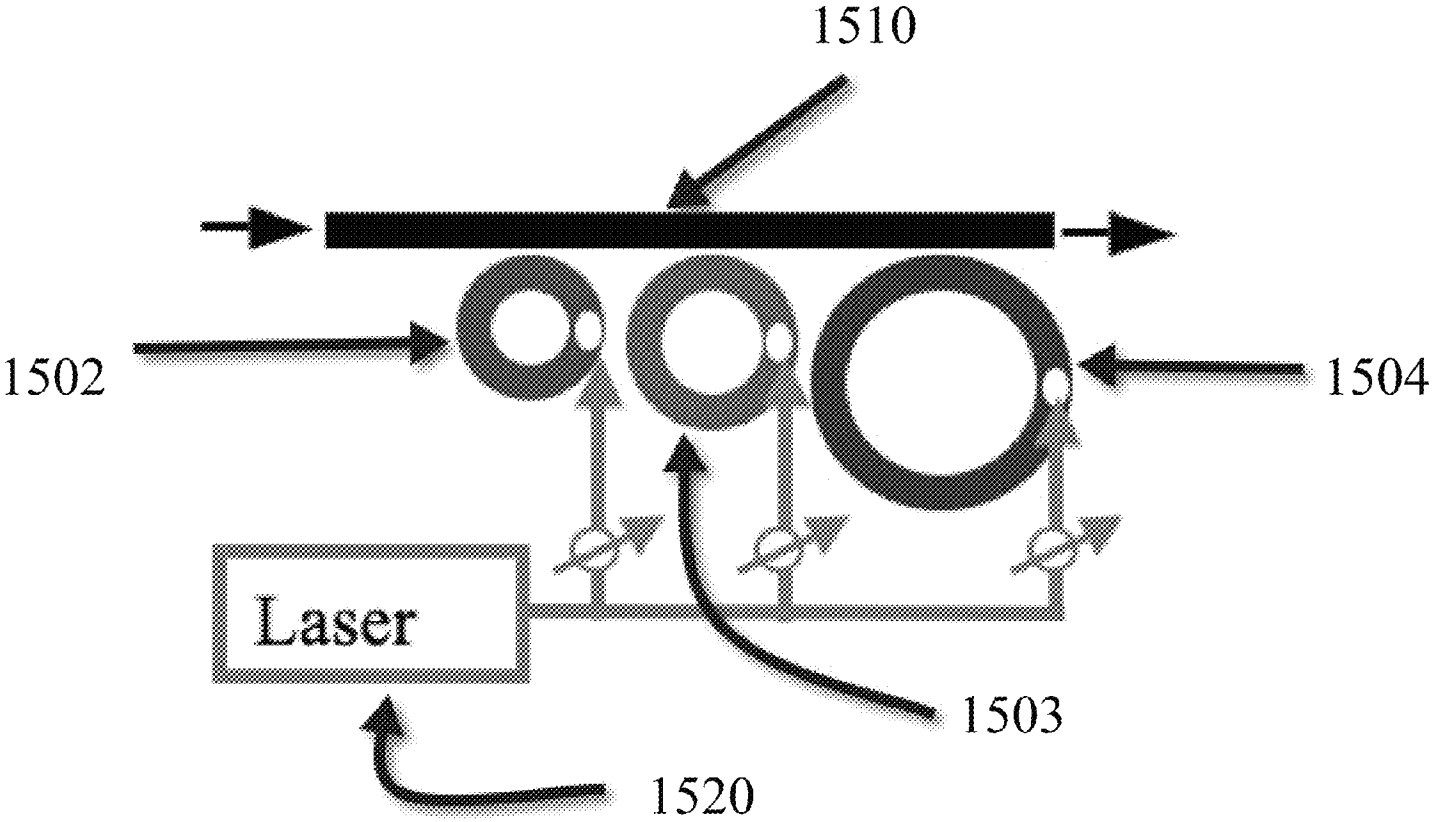
FIG. 15 is a schematic diagram of coupling rings with different diameters to create narrow stop bands that can be interleaved to cover a broad spectrum.
Figure 16:
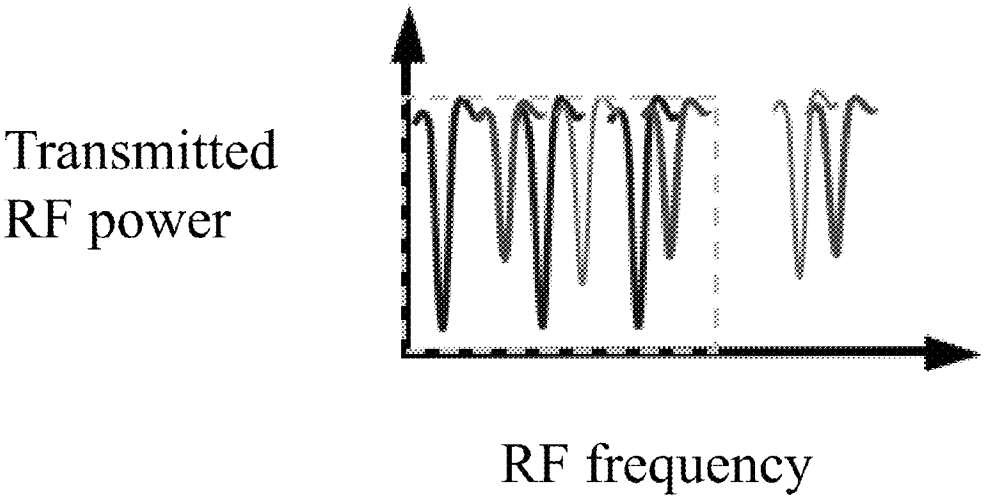
FIG. 16 shows how using controlled optical illumination of certain location on each ring shown in FIG. 15 can produce a tailored spectrum.

FIG. 15 illustrates an alternate embodiment of the invention. As shown, ring resonators 1502-1504 with different diameters are all side-coupled to a single transmission line 1510. In this embodiment, narrow stop bands can be interleaved to cover a broad spectrum. Using controlled optical illumination by laser 1520 of certain locations on each ring, the transmission spectrum of the device can be tailored so as to provide a series of optically controlled interleaved stop-bands as shown in FIG. 16.

Figure 17:
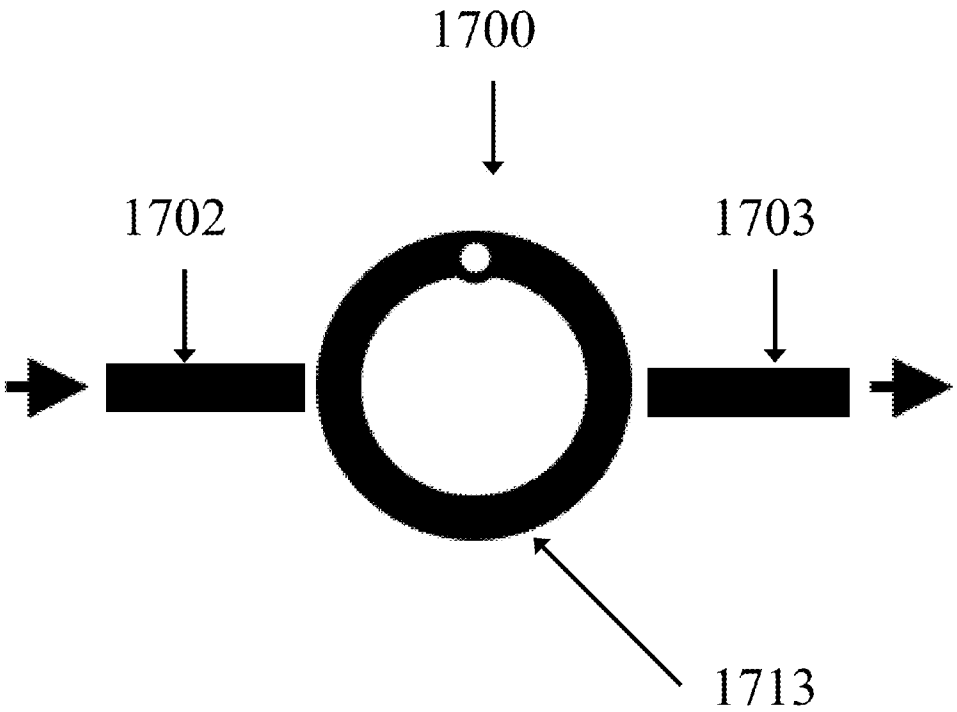
FIG. 17 illustrates a capacitively coupled ring resonator.
Figure 18:
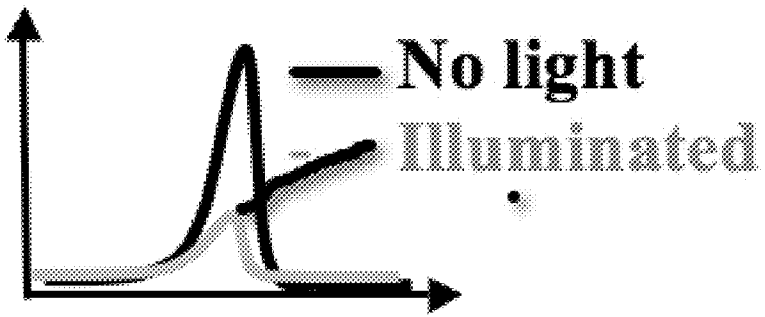
FIG. 18 shows how using controlled optical illumination of the ring shown in FIG. 17 can create a band-pass RF filter.

FIG. 17 shows another embodiment of the invention configured as a capacitively coupled ring resonator 1700. Transmission lines 1702-1703 are capacitive gap coupled to ring resonator 1713. This structure creates a ring based optically controlled band-pass filter with a relatively low insertion loss. FIG. 18 shows how using controlled optical illumination of the ring shown in FIG. 17 can create a band-pass RF filter.

Figure 19:
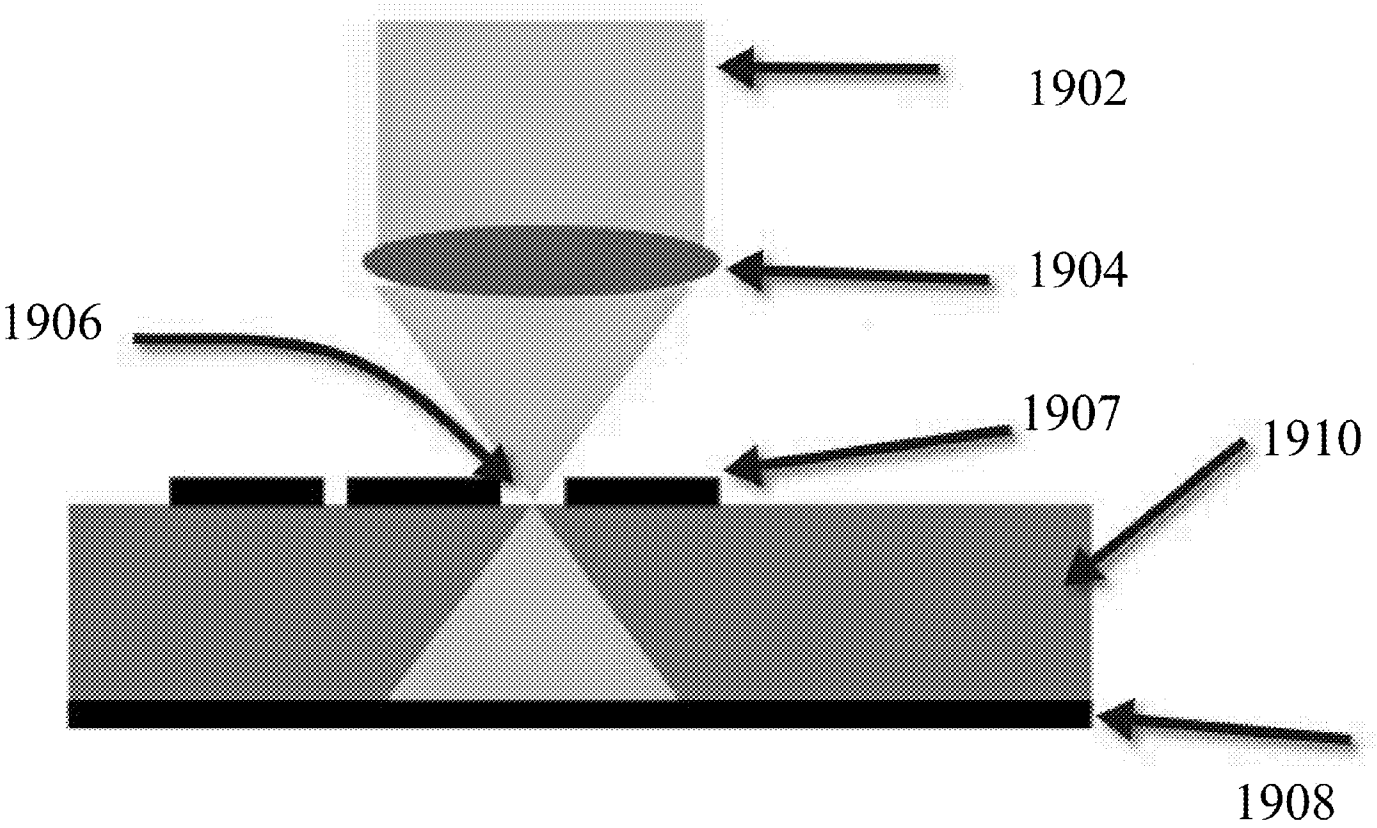
FIG. 19 illustrates an embodiment having a lens for larger distribution of photonically generated carriers.

To improve the efficiency of the microwave device, as shown in FIG. 19, a diverging beam that spreads out after passing through the aperture resulting in a larger spatial distribution of the photo-generated carriers may be used. In this embodiment, light 1902 passes through lens 1904 so that after passing through aperture 1906 of ring 1907 it illuminates a wider region of substrate 1910. Again, the wavelength selected should be able to illuminate twice the thickness of the substrate so that once light reaches conductor 1908 it reflects back up into substrate 1910 to increase the efficiency of the device.

The microwave device of present invention may also include a resonator having a plurality of apertures positioned on the resonator. The apertures are located so as to allow light to be directed to a plurality of interior regions, with each region comprising a large and confined RF field for a specific RF mode.

Bulk illumination combined with high-Q RF resonance can significantly reduce the power consumption in optically controlled microwave devices. For example, using a side coupled RF ring resonator on a silicon substrate and choosing a laser wavelength that generates free carriers across the substrate (as opposed to substrate surface) provides low optical power control of RF transmission near 14 GHz. The results are achieved in a junction-less device or without the use of a compound or active semiconductor. Using the same methodology and only by optimizing the wavelength, substrate thickness and the RF coupling (between the ring and the transmission line) higher efficiencies can be obtained. The band-stop frequencies of this device can be easily tailored by changing the ring radius.

What is claimed is:

1. A microwave device comprising:

a photosensitive body having an interior region comprising a high resonant electric field associated with a designated RF mode, said photosensitive body is planar and uniformly made from silicon;

free carriers or other photo-induced changes in RF permitivity are generated by light directed at said high resonant RE field region of said interior region;

an optical boundary that bounds said substrate and recirculates light in said high resonant RF field region back towards a resonator disposed upon the photosensitive body; and wherein an absorption depth of light is at least twice the thickness of said photosensitive body and a transmitted RF power of the microwave device can be changed more than 5 dB with less than 1 mW of optical power.

2. The microwave device of claim 1, wherein said device is junction-less.

3. A microwave resonator comprising:

a photosensitive substrate made from silicon having a first surface, an opposingly located second surface and an interior region comprising a high resonant electric field associated with a designated RF mode;

an RF resonator patterned on a first surface of the substrate;

an aperture in said resonator positioned to direct light received from a light source to said interior region;

free carriers or other photo-induced changes in RF permitivity are generated by light directed at said high resonant RF field region of said interior region;

an optical boundary located on said second surface of said substrate that bounds said substrate and recirculates light back into said high RF field region of said substrate towards said RF resonator; and wherein an absorption depth of light is at least twice the thickness of said substrate and a transmitted RF power of the microwave resonator can be changed by at least 5 dB with less than 1 mW of optical power.

4. The microwave resonator of claim 3, wherein said aperture is located above said interior region with said high resonant RF field.

5. The microwave resonator of claim 3, wherein said resonator is coupled to a microwave transmission line.

6. The microwave resonator of claim 3, wherein said resonator includes a transmission line side-coupled to a plurality of microrings.

7. The microwave resonator of claim 3, wherein said resonator includes a transmission line side-coupled to a first microring, a second microring side-coupled to said first microring, and a third microring side-coupled to said second microring.

8. The microwave resonator of claim 3, wherein said resonator includes a transmission line and a plurality of side-coupled microrings.

9. The microwave resonator of claim 8, wherein each of said plurality of side-coupled microrings has a different diameter.

10. The microwave resonator of claim 3, further including a lens to distribute said light.

11. The microwave resonator of claim 3, wherein said substrate is junction-less.

12. The microwave resonator of claim 3, wherein said resonator includes a first transmission line coupled to a microring and an opposingly located second transmission line coupled to said microring.

13. The microwave resonator of claim 3, wherein said aperture includes a plurality of apertures positioned on said resonator to direct light to a plurality of interior regions included within said interior region, each of said interior regions comprising a maximum resonant RF field of said high resonant electric field for the designated RF mode.

14. A microwave resonator comprising:

a photosensitive substrate uniformly made from silicon having a first surface, an opposingly located second surface and an interior region comprising a high resonant electric field associated with a designated RF mode;

an RF resonator patterned on a first surface of the substrate, said resonator having a plurality of side-coupled microrings having different diameters;

an aperture in each of said microrings positioned to direct light received from a light source to said interior region;

free carriers or other photo-induced changes in RF permitivity are generated by light directed at said high resonant RF field region of said interior region;

an optical boundary located on said second surface of said substrate and opposingly located from said RF resonator, said optical boundary bounds said substrate and recirculates light back into said high RF field region towards said RF resonator; and wherein an absorption depth of light is approximately twice the thickness of said substrate and a transmitted RF power of the microwave resonator can be changed by at least 5 dB with less than 1 mW of optical power.

* * * * *